US005347972A

United States Patent [19]

Sandou et al.

[11] Patent Number: 5,347,972

[45] Date of Patent: Sep. 20, 1994

[54] SUPERCHARGE PRESSURE CONTROL SYSTEM IN INTERNAL COMBUSTION ENGINE

[75] Inventors: Yasuyuki Sandou; Nobu Takahashi, both of Saitama, Japan

[73] Assignee: Honda Giken Kogyo Kabushiki Kaisha, Tokyo, Japan

[21] Appl. No.: 997,359

[22] Filed: Dec. 28, 1992

[30] Foreign Application Priority Data

Dec. 26, 1991 [JP] Japan ..... 3-345464
Oct. 1, 1992 [JP] Japan ..... 4-263282

[51] Int. Cl.[5] ..... F02B 33/36
[52] U.S. Cl. ..... 123/564
[58] Field of Search ..... 60/611; 123/564

[56] References Cited

U.S. PATENT DOCUMENTS 5,090,392 2/1992 Nakano et al. ..... 123/564
5,115,788 5/1992 Sasaki et al. ..... 123/564
5,207,206 5/1993 Takahashi et al. ..... 123/564

*Primary Examiner*—Michael Koczo
*Attorney, Agent, or Firm*—Lyon & Lyon

[57] ABSTRACT

A system for controlling the supercharge pressure in an internal combustion engine having a mechanical supercharger which is connected to the crankshaft of an engine and includes a variable compressing construction capable of varying the internal compression ratio. The system comprises a supercharge pressure varying assembly for varying the supercharge pressure, a detector for detecting the operational condition of the supercharge pressure varying assembly, and a control device for operating the supercharge pressure varying assembly into a supercharge pressure reducing position in response to the detection, by the detector, of the fact that the supercharge pressure varying assembly is in a low level compressing state in an operational condition of the engine in which the mechanical supercharger should be brought into a high level compressing state. Thus, even if an abnormality occurs in the variable compressing assembly, an increase in the temperature of the intake gas in the engine is prevented.

12 Claims, 18 Drawing Sheets

START
S1
DETECTION OF θ TH
S2
DETECTION OF θ BP
S3
BYPASS CONTROL?
NO
YES
S5
F = 1 ?
YES
NO
S4
FULL OPENING OF V BP
S6
FEEDBACK CONTROL?
NO
YES
S9
CALCULATION OF θ BPO '
S8
CALCULATION OF θ BPF
S7
CALCULATION OF θ BPO
S10
LIMIT CHECK
S11
DRIVING OF V BP
S12
CONTROL OF SWITCHOVER VALVE
S13
DETECTION OF ABNORMALITY
RETURN

SUPERCHARGE PRESSURE CONTROL SYSTEM IN INTERNAL COMBUSTION ENGINE

BACKGROUND OF THE INVENTION

1. Field of the Invention

The present invention relates to a system for controlling the supercharge pressure in an internal combustion engine having a mechanical supercharger which is connected to the crankshaft of the engine and includes a variable compressing means capable of varying an internal compression ratio.

2. Description of the Prior Art

An internal combustion engine having a mechanical supercharger in which the compression ratio is variable is already known, for example, from Japanese Patent Application Laid-Open No. 221634/90.

However, if the engine is brought into an operational condition in which a high supercharge pressure is introduced, when the variable compressing means for varying the internal compression ratio is out of order due to any cause, so that the compression ratio remains low, the temperature of the intake gas in the engine is increased abnormally due to the high supercharge pressure and a reduction in efficiency of the supercharger and as a result, a knocking in the engine is liable to be produced.

SUMMARY OF THE INVENTION

Accordingly, it is an object of the present invention to provide a supercharge pressure control system in an internal combustion engine, wherein the increase in the temperature of the intake gas in the engine can be prevented, even if an abnormality is produced in the variable compressing means.

To achieve the above object, according to the present invention, there is provided a system for controlling the supercharge pressure in an internal combustion engine having a mechanical supercharger which is connected to the crankshaft of the engine and includes a variable compressing means capable of varying the internal compression ratio, the system comprising a supercharge pressure varying means for varying the supercharge pressure, a detector for detecting the operational condition of the variable compressing means, and a control means for operating the supercharge pressure varying means into a supercharge pressure reducing position in response to the detection, by the detector, of the state that the variable compressing means is in a low level compressing state in an operational condition of the engine in which the mechanical supercharger should be brought into a high level compressing state.

With the above construction, even if the variable compressing means is out of order due to any cause, so that it remains in the low level compressing state, the supercharge pressure is forcibly reduced when the engine is brought into an operational condition in which a high supercharge pressure is introduced, and therefore, it is possible to prevent an abnormal increase in the temperature of the intake gas in the engine.

If the control means is arranged to control the supercharge pressure varying means in such a manner that the acceptable maximum supercharge pressure in the event the mechanical supercharger is in the low level compressing state is increased, as the number of revolutions of the engine crankshaft is increased, it is possible to effectively exhibit a supercharge effect by the mechanical supercharger.

The above and other objects, features and advantages of the invention will become apparent from the following description of preferred embodiments, taken in conjunction with the accompanying drawings.

BRIEF DESCRIPTION OF THE DRAWINGS

FIGS. 1 to 14 illustrate a first embodiment of the present invention, wherein FIG. 1 is a diagrammatic illustration of the entire system;

FIG. 2 is a longitudinal side elevation view of a supercharger with a portion shown in section;

FIG. 3 is a sectional end view taken along a line 3—3 in FIG. 2;

FIG. 4 is a sectional plan view taken along a line 4—4 in FIG. 2;

FIG. 5 is a flow chart illustrating a main routine for controlling the operations of a bypass valve and the supercharger;

FIG. 6 is a diagram illustrating a map in which an open control region and a feed-back control region are defined;

FIG. 7 is a graph illustrating the target opening degrees of the bypass valve based on the number of revolutions per unit of time of the engine and the throttle opening degree;

FIG. 8 is a graph illustrating the target supercharge pressure with respect to the throttle opening degree;

FIG. 9 is a diagram illustrating control regions based on the number of revolutions per unit of time of the engine and the throttle opening degree;

FIG. 10 is a diagram for explaining the reason why the acceptable maximum supercharge pressure in a low level compressing state is set so that it is increased, as the number of revolutions of engine is increased;

FIGS. 11 and 12 are portions of a flow chart illustrating a subroutine for controlling the compression ratio of the supercharger;

FIG. 13 is a diagram illustrating a supercharge pressure introducing region and an atmospheric pressure introducing region based on the number of revolutions per unit of time of the engine and the supercharge pressure; and FIG. 14 is a flow chart illustrating a sub-routine for detecting an abnormal condition;

FIGS. 15 and 16 illustrate a second embodiment of the present invention, wherein FIG. 15 is a diagrammatic illustration of the entire system; and FIG. 16 is a flow chart illustrating a sub-routine similar to FIG. 14 for detecting an abnormal condition; and FIGS. 17 and 18 illustrate a third embodiment of the present invention, wherein FIG. 17 is a flow chart illustrating a sub-routine similar to FIG. 14 but in the third embodiment; and FIG. 18 is a diagram illustrating a map for judging an abnormal condition.

DESCRIPTION OF THE PREFERRED EMBODIMENTS

The present invention will now be described by way of preferred embodiments in connection with the accompanying drawings. FIGS. 1 to 4 illustrate the structure of a first embodiment of the present invention.

Figure 1:
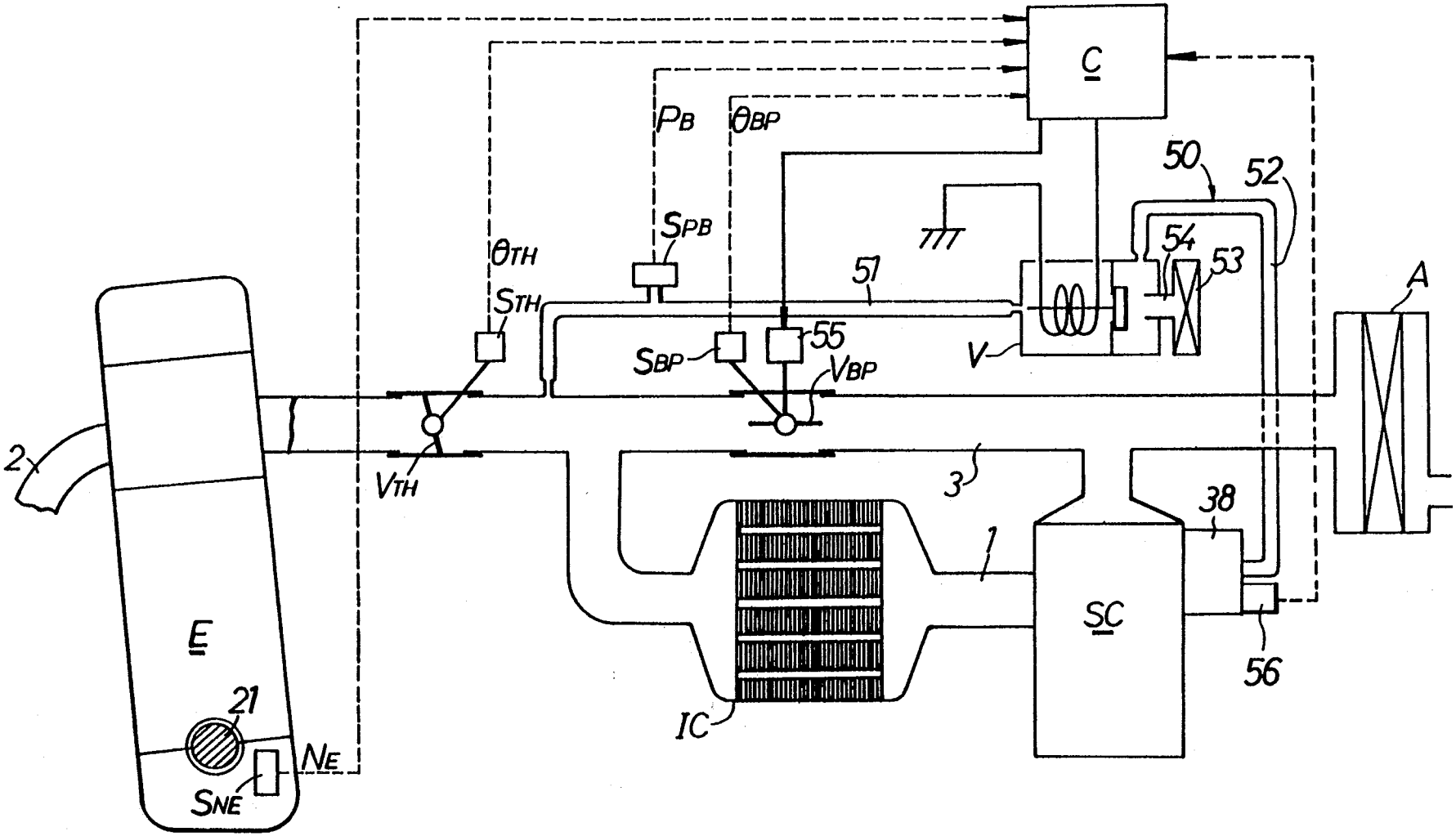

Referring first to FIG. 1, an intake passage 1 and an exhaust passage 2 are connected to an internal combustion engine E, and an air cleaner A is connected to an upstream end of the intake passage 1. Provided in the middle of the intake passage 1 are, in sequence from the upstream side thereof, a mechanical supercharger SC, an intercooler IC and a throttle valve $V_{TH}$. A bypass passage 3 is connected to the intake passage 1 to bypass the mechanical supercharger SC and the intercooler IC. A bypass valve $V_{BP}$ as a supercharge pressure varying means is provided in the bypass passage 3.

Figure 2:
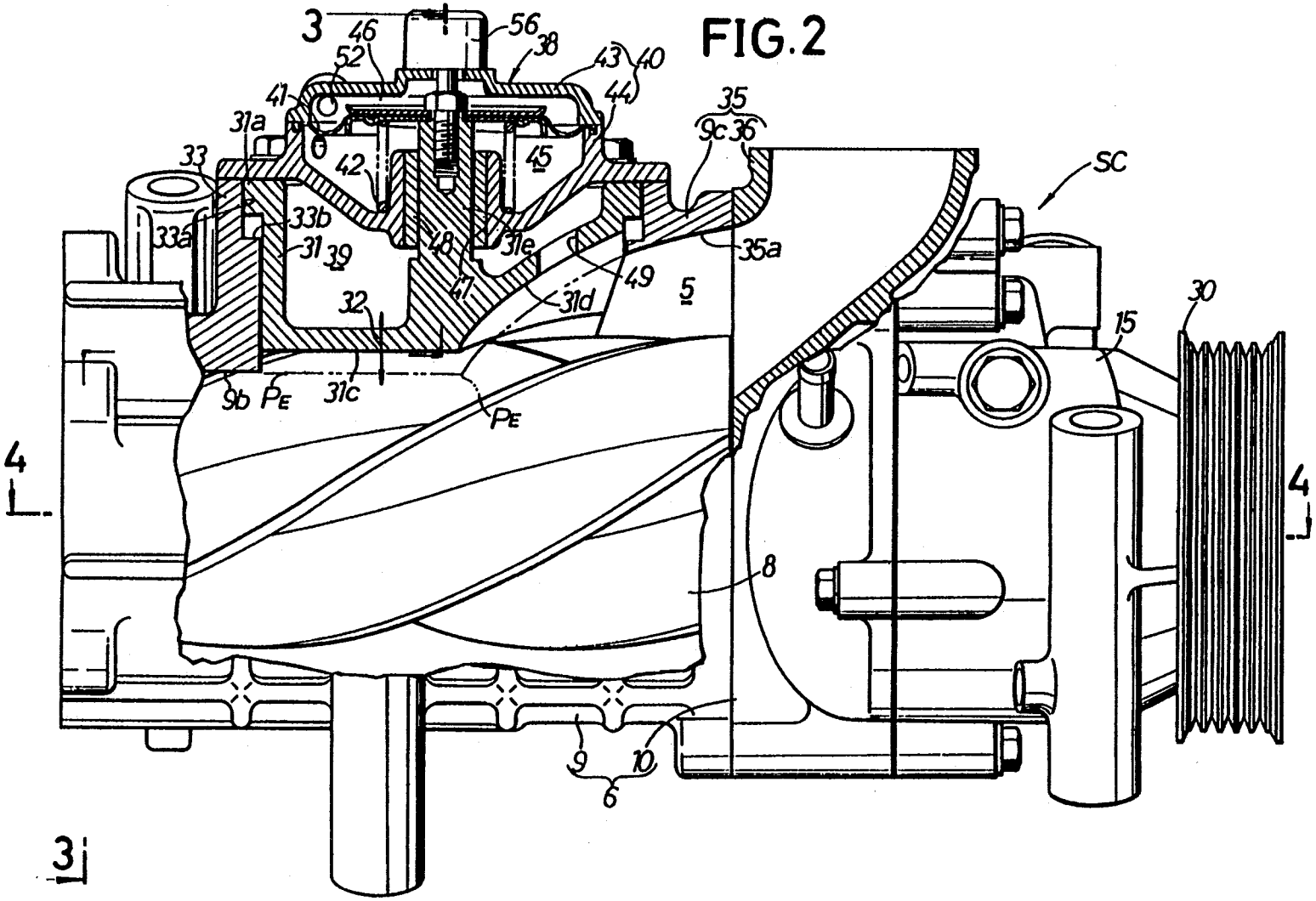
Figure 3:
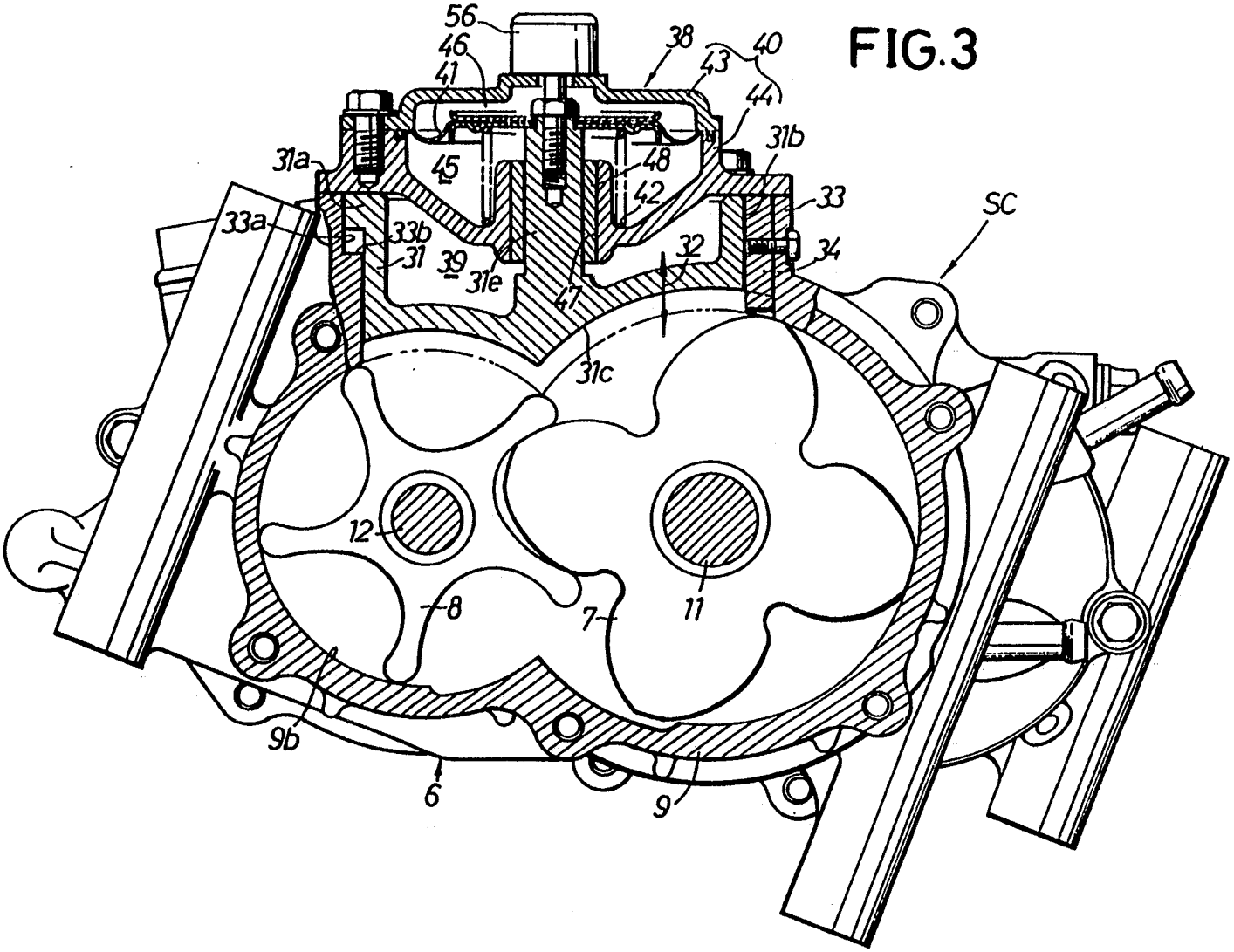
Figure 4:
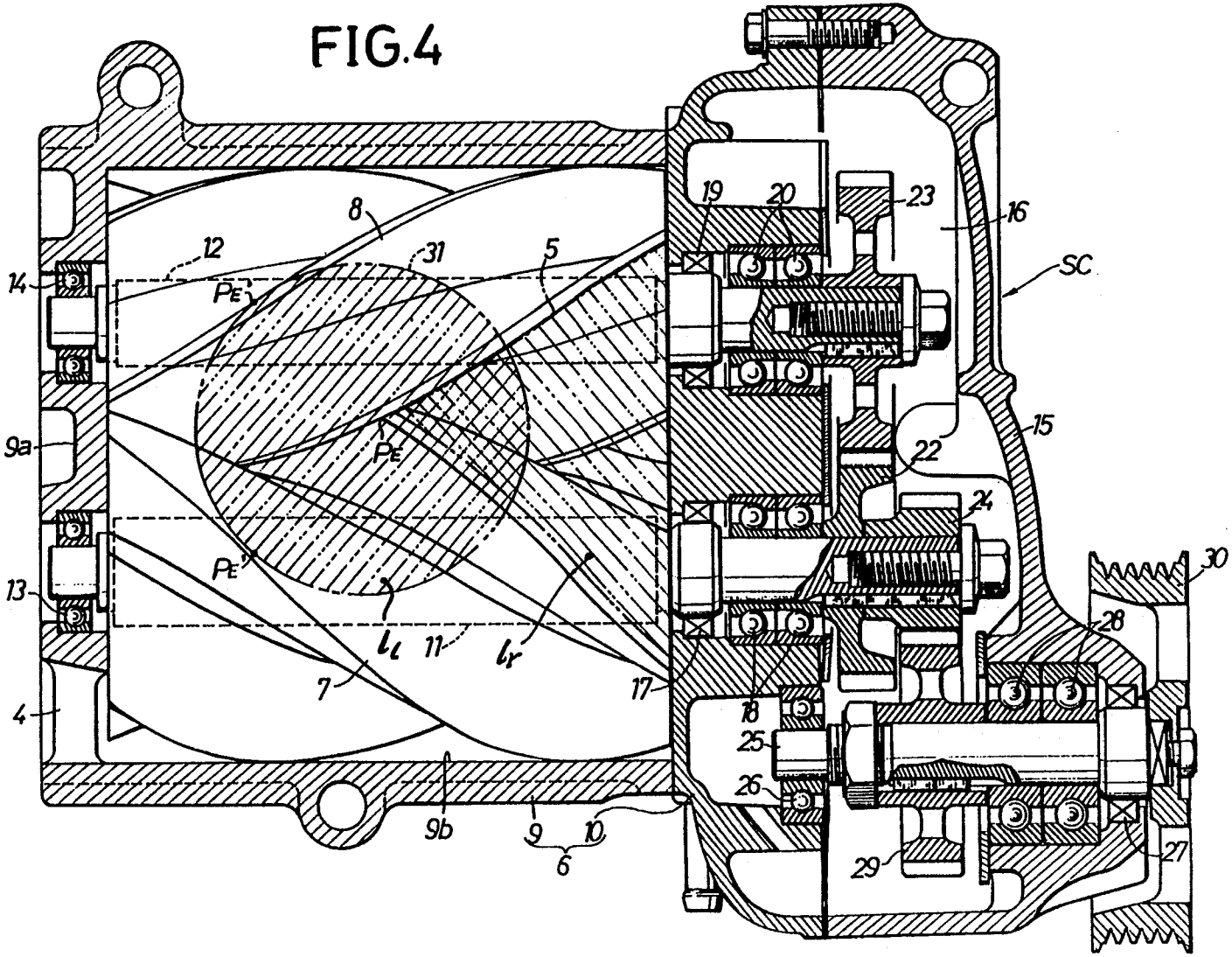

Referring to FIGS. 2, 3 and 4, the mechanical supercharger SC comprises a main rotor 7 and a gate rotor 8 which are a pair of mutually meshed screw rotors and are rotatably carried in a housing 6. Air drawn through an intake port 4 in one axial end of the housing 6 is discharged through a discharge port 5 in the other axial end by the rotors 7 and 8 which are rotatively driven by the engine E.

The housing 6 is comprised of a cylindrical member 9 formed into a bottomed cylindrical shape with one end closed by an end wall 9*a*, and an end wall member 10 coupled to the cylindrical member 9 to cover an opened end thereof. The cylindrical member 9 has an inner surface 9*b* which is formed into a cross-sectional shape corresponding to rotational loci described by radially outer ends of the rotors 7 and 8 and which is not in contact with the rotors 7 and 8. The intake port 4 is provided in the end wall 9*a*.

The rotors 7 and 8 are secured to rotary shafts 11 and 12, respectively. Each of the rotary shafts 11 and 12 is supported at one end thereof on the end wall 9*a* of the cylindrical member 9 through bearings 13 and 14, respectively. A cover 15 is coupled to the end wall member 10 to define a gear chamber 16 therebetween. The other ends of the rotary shafts 11 and 12 protrude through the end wall member 10 into the gear chamber 16. A seal member 17 and a pair of bearings 18 are interposed between the rotary shaft 11 and the end wall member 10. A seal member 19 and a pair of bearings 20 are interposed between the rotary shaft 12 and the end wall member 10.

Gears 22 and 23 mesh with each other and are fixed to the rotary shafts 11 and 12, respectively, within the gear chamber 16. A shaft 25 is rotatably supported at one end thereof on the end wall member 10 with a bearing 26 interposed therebetween and has an axis parallel to both the rotary shafts 11 and 12. The shaft 25 protrudes outwardly through the cover 15. A seal member 27 and a pair of bearings 28 are interposed between the shaft 25 and the cover 15. A gear 29 is fixed to the shaft 25 within the gear chamber 16 and is meshed with the gear 24. A pulley 30 is fixed to the outer end of the shaft 25 which protrudes from the cover 15. The power from a crankshaft 21 (see FIG. 1) in the engine E is transmitted through an endless belt or belts (not shown) to the pulley 30, thereby causing the main rotor 7 and the gate rotor 8 to be rotatively driven in meshing engagement with each other and synchronously with the engine crankshaft 21.

A piston 31 is disposed on a side of the cylindrical member 9 of the housing 6 at a location corresponding to meshed portions of the main and gate rotors 7 and 8. The piston 31 is movable between an inward high level compressing position (a position shown by a dashed line in FIGS. 2 and 3) as viewed in a moving direction 32 substantially perpendicular to the axes of the screw rotors 7 and 8 and an outward low level compressing position (a position shown by a solid line in FIGS. 2 and 3) as viewed in the moving direction 32. More specifically, the cylindrical member 9 has a cylindrical guide portion 33 of a circular cross-section integrally provided on a side thereof to extend in a direction perpendicular to the axes of the rotors 7 and 8, and the piston 31 is disposed within the cylindrical guide portion 33 for movement in the moving direction 32. Moreover, the piston 31 is formed into a circular shape in cross section with an outside diameter smaller than the inside diameter of the cylindrical guide portion 33 and is not supported by the cylindrical guide portion.

The piston 31 is formed into a bottomed cylindrical configuration with a closed end turned into the housing 6 and has a radially outward protruding collar 31*a* provided at an opened or outer end thereof. On the other hand, the cylindrical guide portion 33 has an enlarged diameter hole portion 33*a* provided in an inner surface thereof near the axially outer end above an outward-turned step 33*b* to permit the movement of the collar 31*a* in the moving direction 32, so that the axial position of the piston 31 is defined by a case 40 coupled to the outer end of the cylindrical guide portion 33 and by the step 33*b*. An axially extending key 34 is secured to one point of the inner cylindrical surface of the cylindrical guide portion 33, and a notch 31*b* is provided in the collar 31*a* in the piston 31, so that the key 34 is fitted into the notch 31*b*. Thus, rotation of the piston 31 about its axis is inhibited, but the piston 31 is movable in the moving direction 32.

The discharge port 5 is defined by the cooperation of the piston 31 and a projecting portion 35 provided at the axial end of the housing 6 at a location corresponding to the meshed portions of the main and gate rotors 7 and 8. The protruding portion 35 is comprised of a raised portion 9*c* provided at that end of the cylindrical member 9 of the housing and raised outwardly from the inner surface 9*b*, and a cylindrical projection 36 provided on the end wall member 10. A portion of the piston 31 facing the inside of the housing 6 is formed so that the distance from the intake port 4 in a discharge-starting portion $P_E$ of the discharge port 5 when the piston 31 is in the high level compressing position is larger than the distance from the intake port 4 in a discharge-starting portion $P_E'$ of the discharge port 5 when the piston 31 is in the low level compressing position. Such portion of the piston 31 facing the inside of the housing 6 is provided with a surface smoothly connected to the inner surface 9*b* of the housing 6, and a surface 31*d* smoothly connected to an inner surface 35*a* of the protruding portion 35, when the piston 31 is in the high level compressing position. Thus, when the piston 31 is in the high level compressing position, an area shown by rightward-declining oblique dashed lines Tr in FIG. 4 is the discharge port 5, and the connection between the surfaces 31*c* and 31*d* is the discharge-starting portion $P_E$. When the piston 31 is in the low level compressing position, an area shown by both the leftward-declining oblique dashed lines l, and rightward-declining oblique dashed lines lr in FIG. 4 is the discharge port 5 due to the fact that the surface 31*c* is located more outward than the inner surface 9*b* of the housing 6, and the two locations in which the grooves in the rotors 7 and 8 are first put into communication with the discharge port 5 in response to the rotation of the rotors 7 and 8 are the discharge-starting positions $P_{E'}$, $P_{E'}$. When the piston 31 is brought into the low level compressing position, so that the discharge-starting positions $P_{E'}$, $P_{E'}$ are closer to the intake port 4, the internal compression ratio is 1.0ϵ. When the piston 31 is brought into the high level compressing position, so that the discharge-starting positions $P_E$ is spaced apart from the intake port 4, the internal compression ratio is, for example, 1.3ε.

A drive mechanism 38 is connected to the piston 31. The drive mechanism 38 comprises a case 40 coupled to the outer end of the cylindrical guide portion 33 to define a back pressure chamber 39 between the case 40 and the piston 31, a diaphragm 41 accommodated in the case 40 with its peripheral edge clamped by the case 40, and a spring 42 mounted in a compressed manner between the diaphragm 41 and the case 40. The case 40 is comprised of a pair of case members 43 and 44 coupled to each other, and the peripheral edge of the diaphragm 41 is clamped between both the case members 43 and 44. The inside of the case 40 is divided by the diaphragm 41 into an inner atmospheric pressure chamber 45 as viewed in the moving direction 32 of the piston 31, and an outer control chamber 46 as viewed in the moving direction 32. The spring 42 is accommodated in the atmospheric pressure chamber 45 to exhibit a spring force for biasing the diaphragm 41 in a direction to reduce the volume of the control chamber 46. A through hole 47 is provided in a central portion of the case member 44 partitioning the back pressure chamber 39 and the atmospheric pressure chamber 45 in the case 40. A cylindrical bearing sleeve 48 is fitted and fixed in the through hole 47. The piston 31 is integrally provided with a connecting rod 31*e* extending in the moving direction 32. The connecting rod 31*e* is slidably passed through the bearing sleeve 48 and connected to a central portion of the diaphragm 41.

In this way, the piston 31' is not supported by the cylindrical guide portion 33 but rather is supported on the drive mechanism 38 through the connecting rod 31*e*. Thus, the sliding contact area of the piston 31 when it is moved in the moving direction 32 can be reduced to provide a reduction in friction loss, and it is possible to prevent a sticking of the piston 31 within the cylindrical guide portion 33 due to the deformation of the piston 31, which is caused by thermal influence, because the piston 31 is near the discharge port 5 which reaches a relatively high temperature.

With such drive mechanism 38, the piston 31 is moved to the high level compressing position against the spring force of the spring 42 by an increase in pressure in the control chamber 46, and moved to the low level compressing position by the spring force of the spring 42, when the pressure in the control chamber 46 is reduced.

The piston 31 is provided with a communication hole 49 for communicating the back pressure chamber 39 with the discharge port 5, so that the pressure in the back pressure chamber 39 is equal to the discharge pressure in the discharge port 5.

Returning to FIG. 1, a variable compressing means 50 capable of varying the internal compression ratio of the supercharger SC in accordance with the operational condition of the engine includes the drive mechanism 38 in the supercharger SC and a switchover valve V capable of being shifted between a state permitting the introduction of atmospheric pressure into the control chamber 46 in the drive mechanism 38 and a state permitting the introduction of a supercharge pressure $P_B$ into the control chamber 46.

A conduit 51 is connected from the valve V to the intake passage 1 at a point corresponding to the joining location of the intake passage 1 and the bypass passage 3, which is more downstream than the intercooler IC. A conduit 52 is connected from the valve V to the control chamber 46 in the drive mechanism 38. The switchover valve V is a solenoid valve interposed between a passage 54 opened into the atmosphere through an air cleaner 53 as well as the conduit 51 and the conduit 52, and is alternatively shifted between a state permitting the communication of the passage 54 with the conduit 52, i.e., the state permitting the introduction of the atmospheric pressure into the control chamber 46 upon energization thereof, and a state permitting the communication of the conduit 51 with the conduit 52, i.e., the state permitting the introduction of a supercharge pressure $P_B$ into the control chamber 46 upon deenergization thereof. Thus, the supercharger SC is adjusted to a low level compressing state, when the atmospheric pressure is permitted to be introduced into the control chamber 46 by the switchover valve V, and the supercharger SC is adjusted to the high level compressing state, when the supercharge pressure $P_B$ is permitted to be introduced into the control chamber 46 by the switchover valve V.

As shown in FIGS. 2 and 3, a detector 56 is mounted to the case member 43 of the case 40 of the drive mechanism 38 and is adapted to be brought into contact with the central portion of the diaphragm 41 in order to detect the compressing state of the supercharger SC, when the supercharger SC is in the low level compressing state.

The shifting operation of the switchover valve V in the variable compressing means 50 and the operation of a bypass valve driving means 55 for driving the bypass valve $V_{BP}$ to open and close the latter are controlled by a control means C including a microcomputer. The control means C controls the operations of the switchover valve V and the bypass valve driving means 55 in accordance with the throttle opening degree $\theta_{TH}$ of the throttle valve $V_{TH}$, the number $N_E$ of revolutions per minute of engine crankshaft 21, the bypass opening degree $\theta_{BP}$ of the bypass valve $V_{BP}$, the supercharge pressure $P_B$ and the result of detection by the detector 56. To this end, signals from a throttle opening degree detecting sensor $S_{TH}$ for detecting the throttle opening degree $\theta_{TH}$, a revolution-number detecting sensor $S_{NE}$ for detecting the number $N_E$ of revolutions of the engine crankshaft, a bypass opening degree detecting sensor $S_{BP}$ for detecting the bypass opening degree $\theta_{BP}$ and a supercharge pressure detecting sensor $S_{PB}$ mounted in the middle of the conduit 51 are supplied to the control means C.

The control procedure established in the control means C now will be described. At a first step S1 and a second step S2 shown in FIG. 5, the throttle opening degree $\theta_{TH}$ and the bypass opening degree $\theta_{BP}$ are detected, progressing to a third step S3.

At the third step S3, it is judged whether or not the bypass control should be carried out. More specifically, it is decided that the bypass control should be stopped, i.e., that air flow through bypass passage 3 should be unrestricted, when the temperature of the intake gas is too low or high; the temperature of engine-cooling water is too low or high and the engine load is extremely high. On the basis of this decision, the opening degree of the bypass valve $V_{BP}$ is fully opened at a step S4, progressing to a tenth step S10. On the other hand, when the engine is in a normal operational condition outside of the above-described conditions, it is decided that the bypass control should be carried out, progressing to a fifth step S5.

At the fifth step S5, it is judged whether or not a flag F is at "1". The flag F is at "1" (F=1) in an abnormal condition in which the supercharger SC is in the low level compressing state when the engine should be operated at a high supercharge pressure. At a 13th step S13, which will be described hereinafter, the detection of the abnormal condition is carried out. The flag F is at "0" (F=0), when a first calculation is to be performed. If F=0 at the step S5, the processing is advanced to a sixth step S6. If F=1 at the step S5, the processing is advanced to a ninth step S9.

Figure 6:
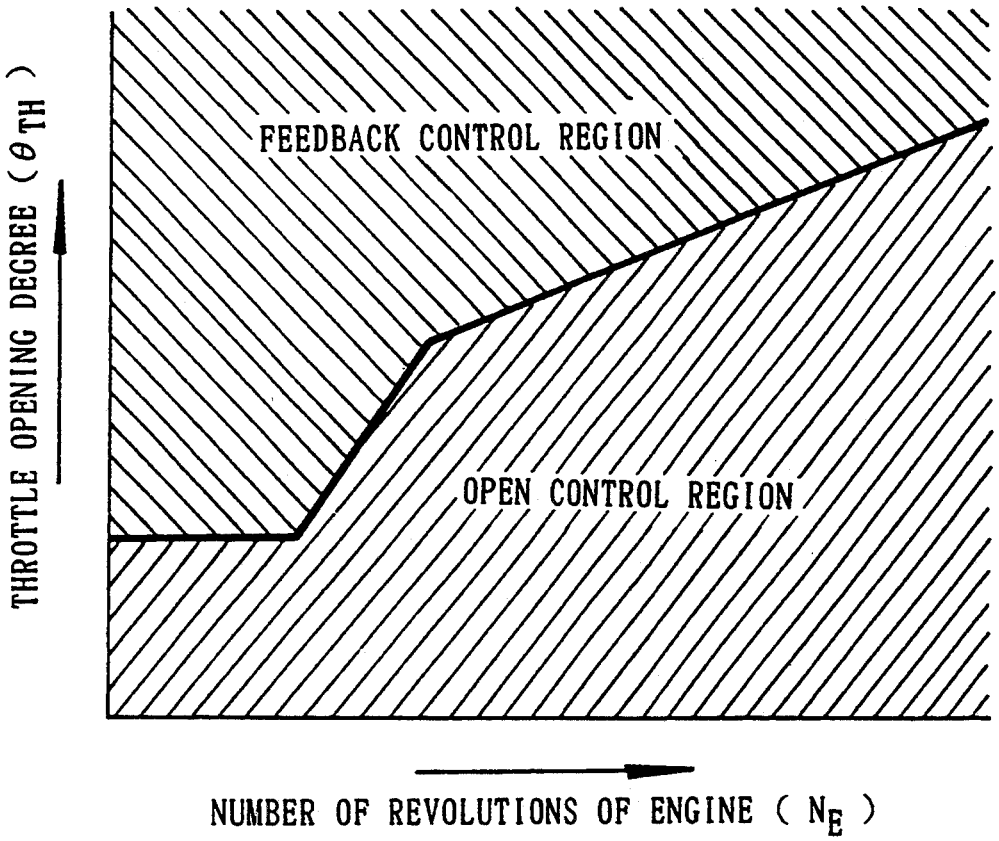

At the sixth step S6, it is judged whether or not the operational condition of the engine is in a feed-back control region. The feed-back control region is established in an area in FIG. 6 in which the number $N_E$ of revolutions of the engine crankshaft is relatively low and the throttle opening degree $\theta_{TN}$ is relatively large. In this region, the feed-back control is carried out, because it is difficult to vary the supercharge pressure $P_B$ by the control of the opening and closing of the throttle valve $V_{TH}$, and the control of the opening and closing of the bypass valve $V_{BP}$ is predominantly effective. In an open control region established in an area in which the number $N_E$ of revolutions of the engine crankshaft is relatively high and the throttle opening degree $\theta_{TH}$ is relatively small, an open control is carried out, because it is easy to vary the supercharge pressure $P_B$ by the control of the opening and closing of the throttle valve $V_{TH}$. It should be noted that a boundary value between the feed-back control region and the open control region is set to have a hysteresis.

Figure 7:
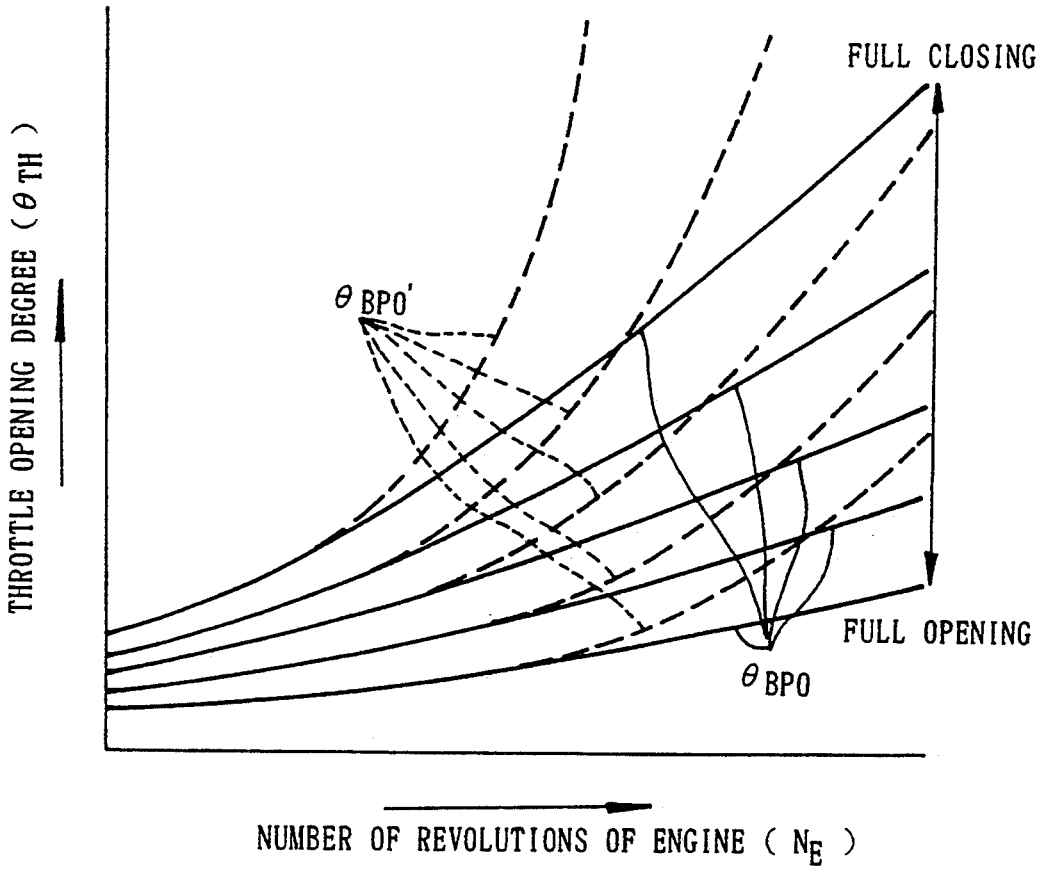

If it is decided at the sixth step S6 that the operational condition of the engine is in the open control region, the processing is advanced to a seventh step S7. At the seventh step S7, a target opening degree $\theta_{BP}^0$ of the bypass valve $V_{BP}$ during the open control is calculated from a map previously established as shown in FIG. 7, then progressing to the tenth step S10. More specifically, for example, five target opening degrees $\theta_{BP}^0$ including a full opening and a full closing are previously established in accordance with the number $N_E$ of revolutions of the engine crankshaft and the throttle opening degree $\theta_{TH}$, as shown by solid lines in FIG. 7, and according to this map, the target opening degrees $\theta_{BP}^0$ are calculated.

Figure 8:
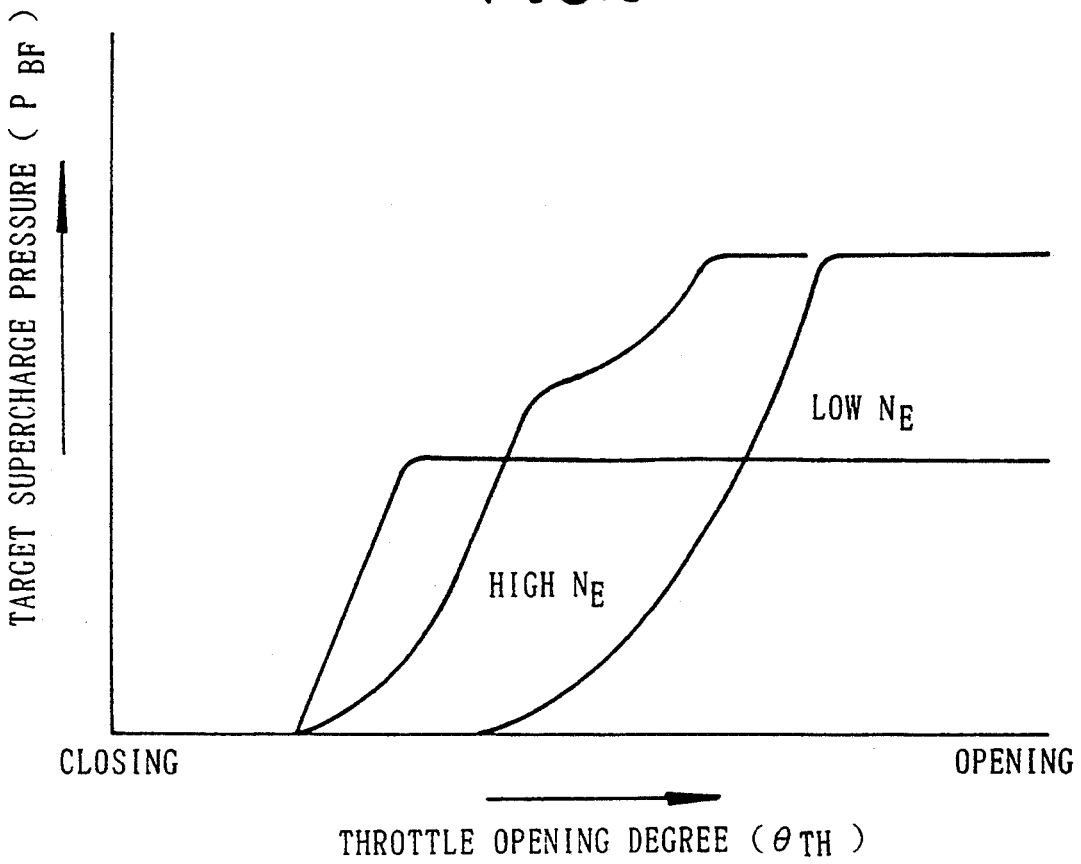

When it is decided at the sixth step S6 that the operational condition of the engine is in the feed-back control region, the processing is advanced to an eighth step S8. At the eighth step S8, a target opening degree $\theta_{BPF}$ of the bypass valve $V_{BP}$ in the feed-back control region is calculated. More specifically, the target supercharge pressure $P_{BF}$ in the feed-back control region is previously established in accordance with the number $N_E$ of revolutions of the engine crankshaft and the target opening degree $\theta_{TH}$ from a map shown in FIG. 8, and the target opening degree $\theta_{BPF}$ of the bypass valve $V_{BP}$ based on the target supercharge pressure $P_{BF}$ is calculated at the eighth step S8.

When the flag F is at "1" at the fifth step S5, i.e., when the processing is advanced from the fifth step S5 to the ninth step S9 as a result of the decision of the fact that the supercharger SC is in the low level compressing state when the engine should be operated at a high supercharge pressure, a target opening degree $\theta_{BP}^{0'}$ of the bypass valve $V_{BP}$ is calculated from the map shown in FIG. 7, progressing to the tenth step S10. More specifically, for example, five target opening degrees $\theta_{BP}^{0'}$ including a full opening and a full closing are previously established in accordance with the number $N_E$ of revolutions of the engine crankshaft and the throttle opening degree $\theta_{TH}$, as shown by dashed lines in FIG. 7. These target opening degrees $\theta_{BP}^{0'}$ are established at a side in which the opening degree is larger, i.e., at a side in which the supercharge pressure is reduced, in the same operational condition of the engine, i.e., under a condition of the same number $N_E$ of revolutions of the engine crankshaft and the same throttle opening degree $\theta_{TH}$, as compared with the target $\theta_{BP}^0$ in the open control region, when the flag F is at "0".

Figure 9:
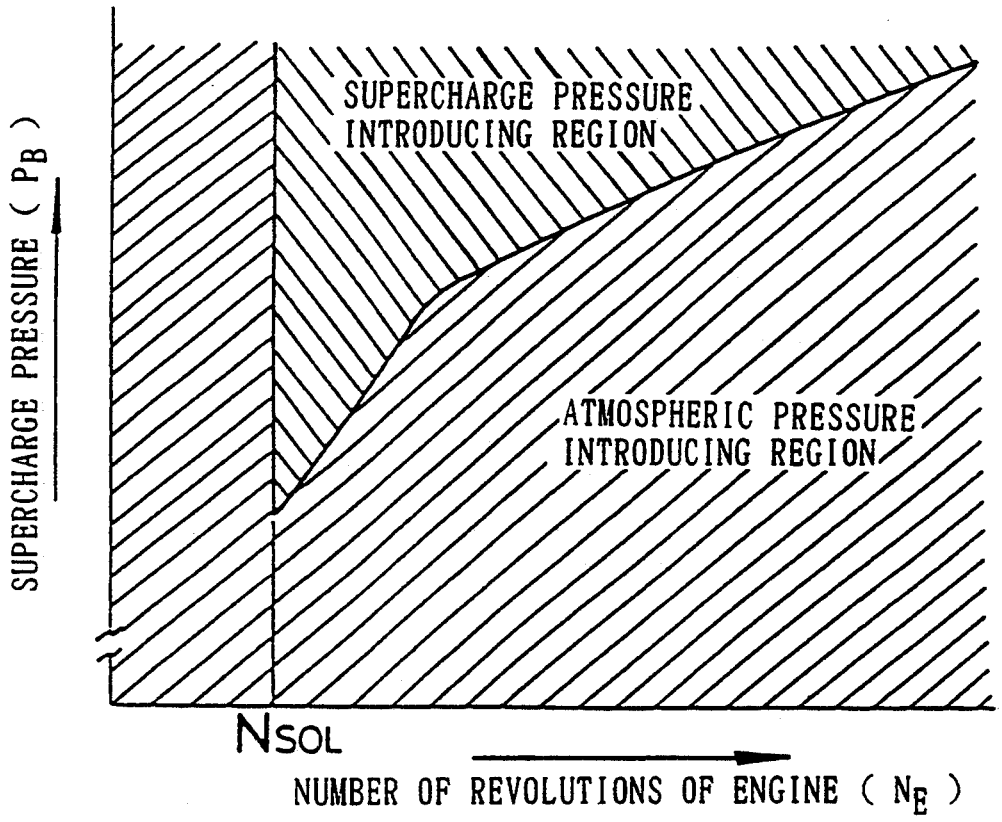

Which of the atmospheric pressure and the supercharge pressure $P_B$ should be introduced into the control chamber 46 in the drive mechanism 38 is previously established in a map shown in FIG. 9. A boundary value between an atmospheric pressure introducing region and a supercharge pressure introducing region in FIG. 9 has a hysteresis and is established so that the operational condition of the engine is brought into the supercharge pressure introducing region by the supercharge pressure $P_B$ which is gradually increased, as the number of revolutions of the engine crankshaft is increased.

Figure 10:
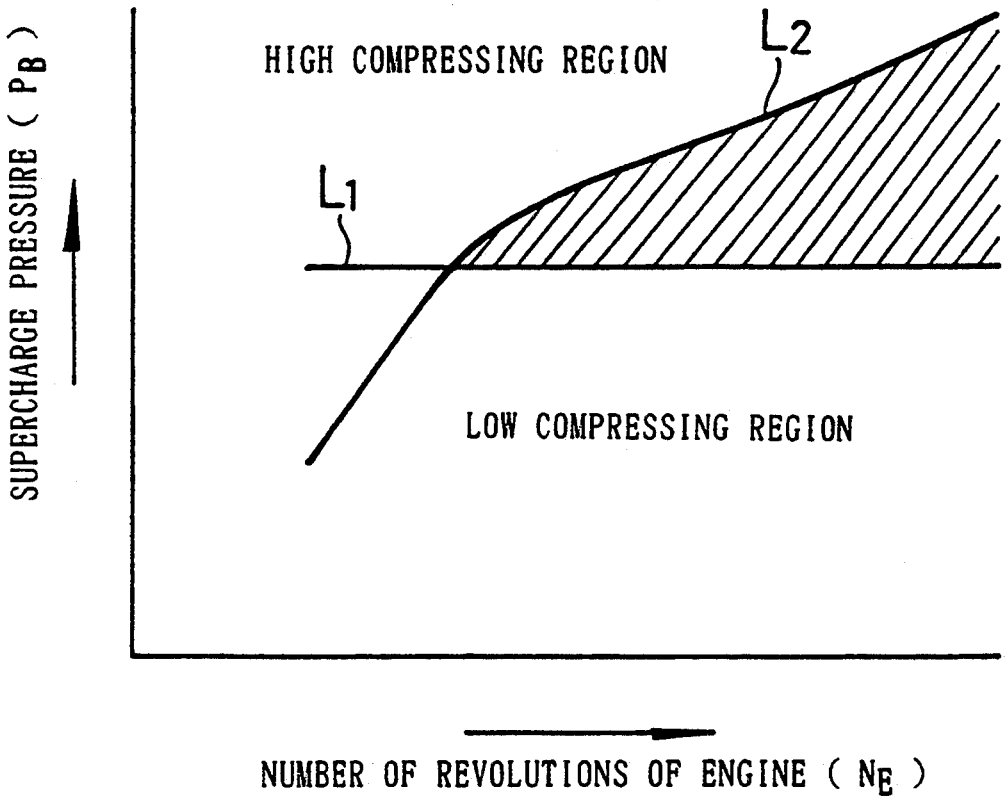

The target opening degree $\theta_{BP}^{0'}$ set at the ninth step S9 is a value in the atmospheric pressure introducing region in FIG. 9, i.e., in a supercharge pressure introducing region when the drive mechanism 38 for the supercharger SC is in the low level compressing state, and the acceptable maximum supercharge pressure when in such low level compressing state is also established so that it is gradually increased, as the number of revolutions of the engine crankshaft is increased, as shown in FIG. 9. This is because it is possible to accommodate a higher supercharge pressure $P_B$ than that at a higher number $N_E$ of revolutions of the engine crankshaft, as the number $N_E$ of revolutions is increased, because even if the operational condition of the drive mechanism 38 for the supercharger SC is constant, the actual internal compression ratio is increased, as the number $N_E$ of revolutions of the engine crankshaft is increased. In other words, if the threshold value is kept constant, as shown by a solid line $L_1$ in FIG. 10, it is possible to accommodate the larger supercharge pressure which is gradually increased, as the number $N_E$ of revolutions of the engine crankshaft is increased, as shown by a line $L_2$ in FIG. 10, and therefore, the obliquely-lined area is wasteful. Thereupon, a supercharge effect can be effectively exhibited, leading to a reduced influence to the drivability, by establishing the acceptable maximum supercharge pressure in the low level compressing state, so that it is increased, as the number $N_E$ of revolutions of the engine crankshaft is increased.

At the tenth step S10, a limit check is carried out to judge whether or not the target opening degrees $\theta_{BP}^0$, $\theta_{BP}^0$ and $\theta_{BP}^{0'}$ of the bypass valve $V_{BP}$ are out of a predetermined range. The bypass valve $V_{BP}$ is operated at an 11th step S11 and then, the control of shifting of the switchover valve V is carried out at a 12th step S12 according to a sub-routine shown in FIGS. 11 and 12.

Figure 11:
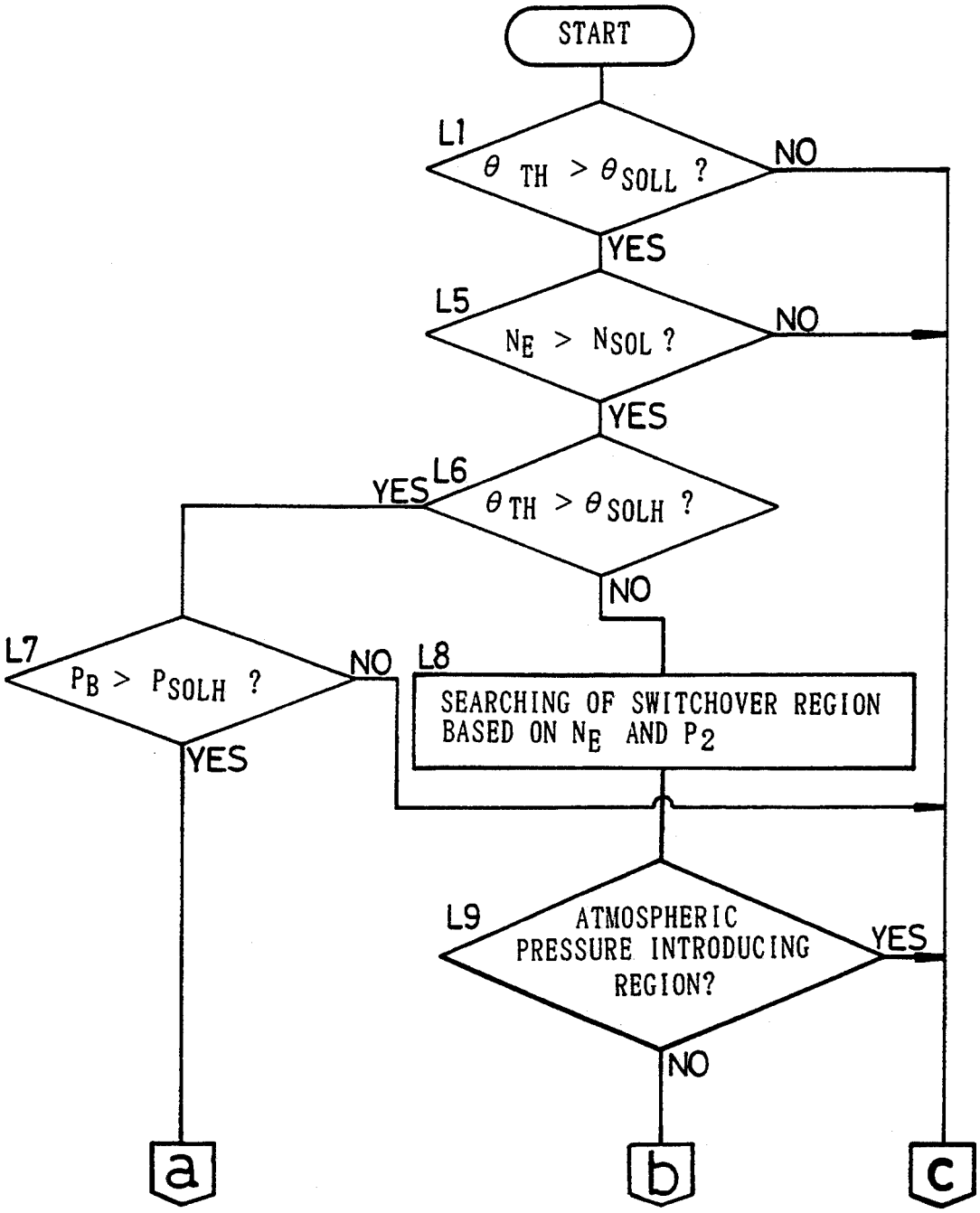
Figure 12:
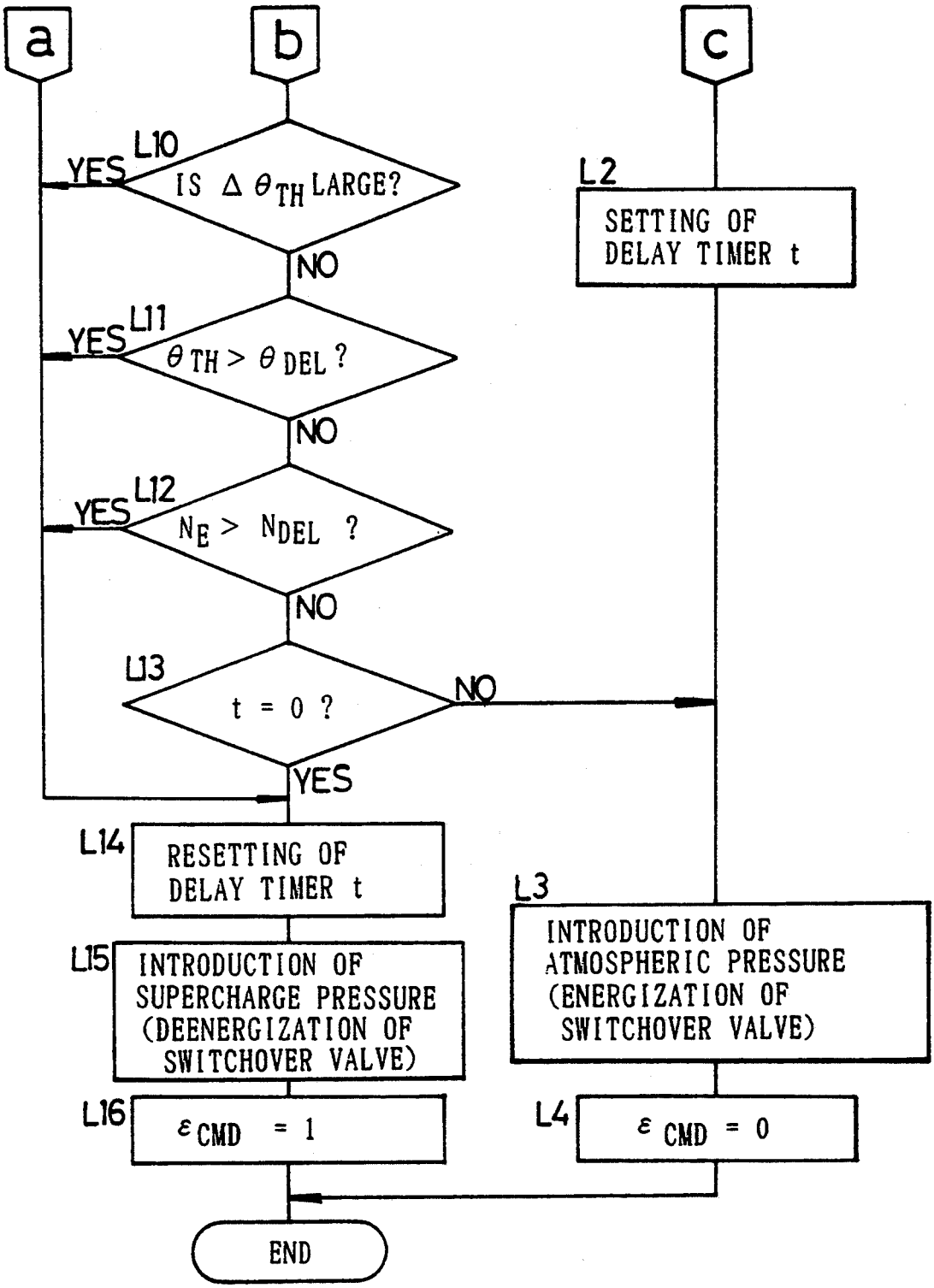

At a first step L1 in the sub-routine in FIGS. 11 and 12, it is judged whether or not the throttle opening degree $\theta_{TH}$ exceeds a preset throttle opening degree $\theta_{SOLL}$ ($\theta_{TH} > \theta_{SOLL}$). The preset throttle opening degree $\theta_{SOLL}$ is used as a judgment criterion in forcibly reducing the internal compression ratio of the supercharger SC on the basis of the fact that when the throttle opening degree $\theta_{TH}$ is smaller, the internal compression ratio of the supercharger SC need not be increased and the supercharge pressure $P_B$ is also smaller, because the bypass valve $V_{BP}$ is open. For example, the preset throttle opening degree $\theta_{SOLL}$ is set at 15/10 degree to have a hysteresis. If $\theta_{TH} \leqq \theta_{SOLL}$, the processing is advanced to a second step L2 (see FIG. 12) at which the count-down of a delay timer set, for example, at 3 seconds is started. At a next third step L3, the switchover valve V is energized, thereby permitting the atmospheric pressure to be introduced into the control chamber 46, and at a fourth step S4, a flag $\epsilon_{CMD}$ is set to "0" ($\epsilon_{CMD}=0$). This flag $\epsilon_{CMD}$ indicates whether or not a signal indicative of a command to operate the variable compressing means 50 to a high level compressing position has been delivered. When $\epsilon_{CMD}=1$, a signal indicative of the command to operate the variable compressing means 50 to the high level compressing position has been delivered. The $\epsilon_{CMD}$ value equal to 0 ($\epsilon_{CMD}=0$) indicates a state that a signal indicative of a command to operate the variable compressing means 50 to a low level compressing position has been delivered.

When it is decided at the first step L1 that $\theta_{TH} > \theta_{SOLL}$, the processing is advanced to a fifth step L5 at which the number $N_E$ of revolutions of the engine crankshaft exceeds a preset number $N_{SOL}$ of revolutions ($N_E > N_{SOL}$). This preset number $N_{SOL}$ of revolutions of the engine crankshaft is used as a judgment criterion in forcibly reducing the internal compression ratio of the supercharger SC, because an increase in supercharge pressure $P_B$ cannot be anticipated in a condition in which the number $N_E$ of revolutions of the engine crankshaft is low. For example, the preset number $N_{SOL}$ of revolutions of engine is set at 1,200/1,000 rpm to have a hysteresis. If it is decided that $N_E \leqq N_{SOL}$, the processing is advanced to the second step L2. If it is decided that $N_E > N_{SOL}$, the processing is advanced to a sixth step S6.

At the sixth step S6, it is judged whether or not the throttle opening degree $\theta_{TH}$ exceeds a preset throttle opening degree $\theta_{SOLH}$ ($\theta_{TH} > \theta_{SOLH}$). This preset throttle opening degree $\theta_{SOLH}$ is used to judge whether or not a vehicle driver has indicated a desire to accelerate, and it is set, for example, at 60/50 degree. If it is decided that $\theta_{TH} > \theta_{SOLH}$, the processing is advanced to a seventh step L7 on the basis of the fact that the driver has a desire to accelerate. At the seventh step L7, it is judged whether or not the supercharge pressure $P_B$ exceeds a preset supercharge pressure $P_{SOLH}$ ($P_B > P_{SOLH}$). This preset supercharge pressure $P_{SOLH}$ is set in order to avoid generating a noise due to a pulsation when the internal compression ratio of the supercharger SC is increased in a condition in which a sufficient supercharge pressure $P_B$ cannot be provided even if the driver has an acceleration desire. The preset supercharge pressure $P_{SOLH}$ is set, for example, at 300 mmHg. If it is decided that $P_B \leqq P_{SOLH}$, the processing is advanced to the second step L2. If it is decided that $P_B > P_{SOLH}$, the processing is advanced to a 14th step L14.

If it is decided at the sixth step L6 that $\theta_{TH} \leqq \theta_{SOLL}$, the processing is advanced to an eighth step LB, where the searching of a switchover region based on the number $N_E$ of revolutions of the engine crankshaft and the supercharge pressure $P_B$ is carried out. That is, the processing is advanced to the eighth step L8 under the condition that the number $N_E$ of revolutions of the engine crankshaft and the throttle opening degree $\theta_{TH}$ are in a range shown by leftward-declining oblique lines in FIG. 13, as a result of the decisions in the steps up to L6, and which of the atmospheric pressure and the supercharge pressure $P_B$ should be introduced into the control chamber 46 in the drive mechanism 38 within this range is searched according to the map shown in FIG. 9.

If it is decided at a ninth step L9 that the operational condition of the engine is in the atmospheric pressure introducing region, the processing is advanced to the second step L2. On the other hand, if is decided at the ninth step L9 that the operational condition of the engine is in the supercharge pressure introducing region, the processing is advanced to a tenth step L10.

At the tenth step L10, it is judged whether or not a variation rate $\Delta\theta_{TH}$ in throttle opening degree $\theta_{TH}$ is equal to or larger than a predetermined value. If the variation rate $\Delta\theta_{TH}$ in throttle opening degree $\theta_{TH}$ is equal to or larger than the predetermined value, the processing is advanced to a 14th step L14 on the basis of the fact that there is an acceleration demand. If the variation rate $\Delta\theta_{TH}$ in throttle opening degree $\theta_{TH}$ is smaller than the predetermined value, the processing is advanced to a 11th step L11. At the 11th step L11, it is judged whether or not the throttle opening degree $\theta_{TH}$ exceeds a preset throttle opening degree $\theta_{DEL}$, e.g., 40 degree ($\theta_{TH} > \theta_{DEL}$). If $\theta_{TH} > \theta_{DEL}$, the processing is advanced to the 14th step L14. On the other hand, if $\theta_{TH} \leqq \theta_{DEL}$, the processing is advanced to a 12th step L12. At the 12th step L12, it is judged whether or not the number $N_E$ of revolutions of the engine crankshaft exceeds a preset revolution number $N_{DEL}$, e.g., 5,000 rpm ($N_E > N_{DEL}$). If it is decided that $N_E > N_{DEL}$, the processing is advanced to the 14th step L14. On the other hand, if it is decided that $N_E \leqq N_{DEL}$, the processing is advanced to a 13th step L13.

At the 13th step L13, it is judged whether or not the delay timer t has taken the count down to "0", i.e., whether or not a predetermined time has been lapsed from the start of the count-down of the delay timer t at the second step L2. If the count-down does not reach "0", the processing is advanced to a third step L3. On the other hand, if the predetermined time has lapsed, i.e., the count-down has reached "0", the processing is advanced to the 14th step L14.

At the 14th step L14, the delay timer t is reset when the processing is advanced to this step L14 from the 7th, 10th, 11th and 12th steps L7, L10, L11 and L12. At a next 15th step L15, the switchover valve V is deenergized so as to permit the supercharge pressure $P_B$ to be introduced into the control chamber 46. At a 16th step L16, the flag $\epsilon_{CMD}$ is brought into "1" ($\epsilon_{CMD}=1$).

Figure 13:
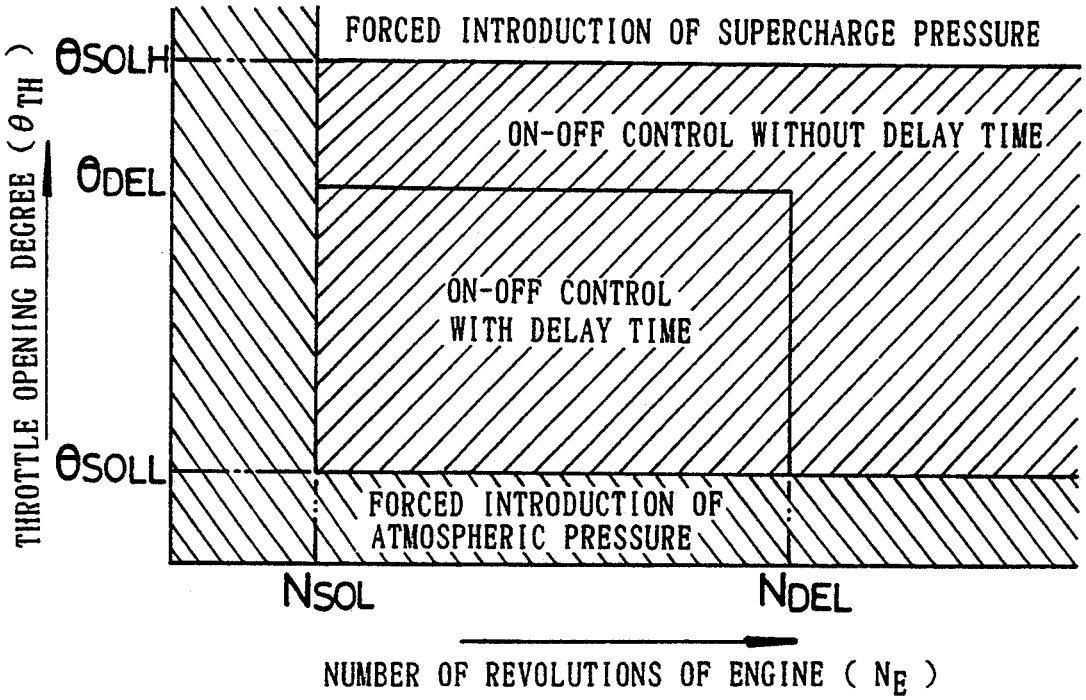

With such sub-routine shown in FIGS. 11 and 12, the operation of the switchover valve V is controlled in accordance with the number $N_E$ of revolutions of the engine crankshaft and the throttle opening degree $\theta_{TH}$, as shown in FIG. 13, so that the switchover valve V is shifted between the state permitting the atmospheric pressure to be introduced into the control chamber 46, thereby bringing the compression ratio $\epsilon$ of the supercharger SC to 1.0, and the state permitting the supercharge pressure $P_B$ to be introduced into the control chamber 46, thereby bringing the compression ratio $\epsilon$ to 1.3. Moreover, in a region in which $\theta_{SOLL} < \theta_{TH} \leqq \theta_{SOLH}$ and $N_E > N_{SOL}$, the shifting of the switchover valve V is controlled according to the map shown in FIG. 9. Even within such region and particularly in a region in which $\theta_{TH} \leqq \theta_{DEL}$ and $N_E > N_{DEL}$, unless the state in which the compression ratio $\epsilon$ of the supercharger SC should be brought to 1.3 is sustained for a predetermined time, e.g., 3 seconds or more, the shifting to the state permitting the supercharge pressure $P_B$ to be introduced into the control chamber 46 to bring the compression ratio $\epsilon$ of the supercharger SC to 1.3 is avoided.

Figure 5:
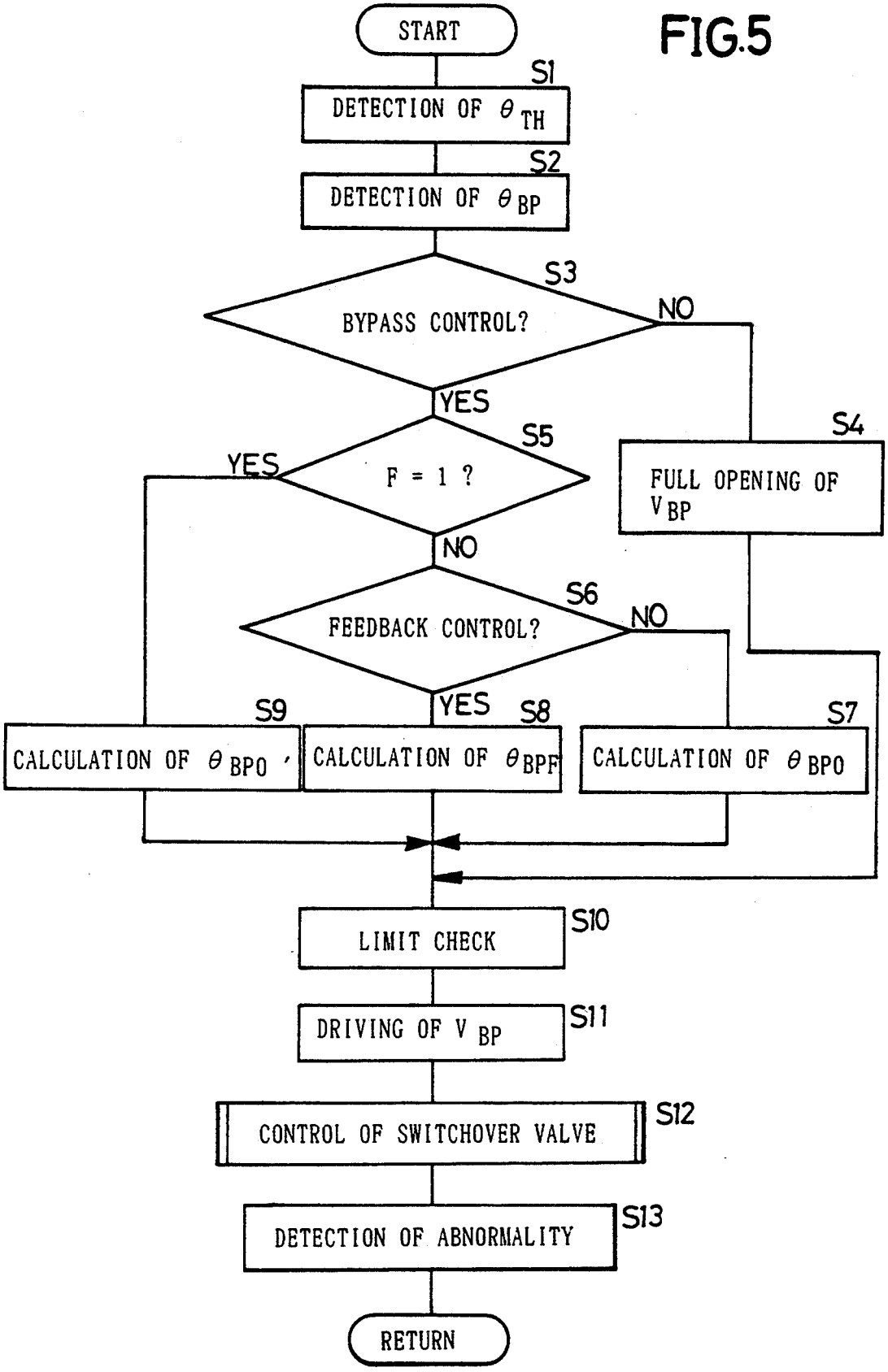
Figure 14:
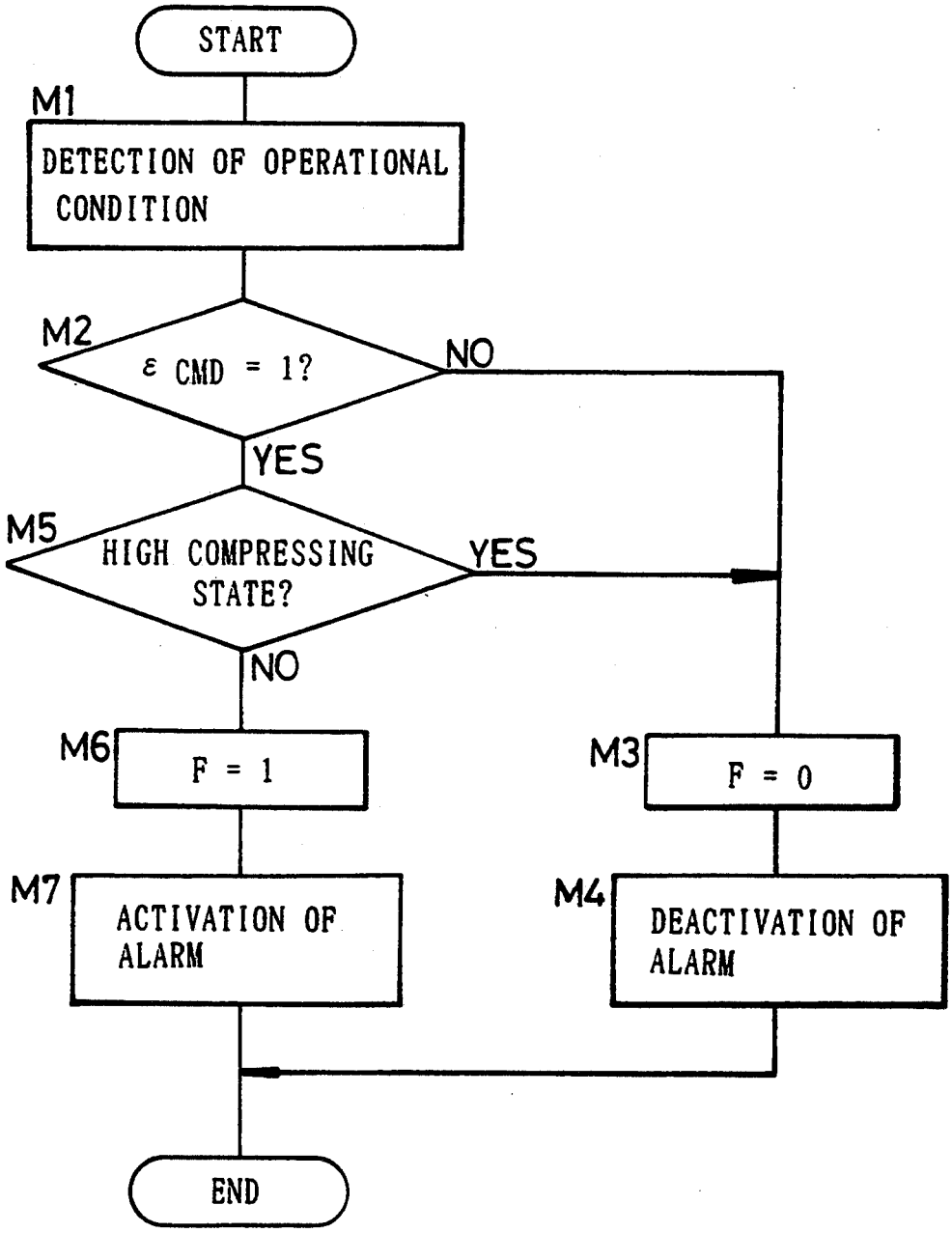

Returning to the main routine shown in FIG. 5, after the control of the switchover valve at the 12th step S12 is carried out, the detection of an abnormal condition is carried out at a 13th step S13 according to a sub-routine shown in FIG. 14.

At a first step M1 in the sub-routine in FIG. 14, the operational condition of the variable compressing means 50 is detected by the detector 56. At a next second step M2, it is judged whether or not the flag $\epsilon_{CMD}$ is equal to 1 ($\epsilon_{CMD}=1$), i.e., whether a signal indicative of a command to bring the variable compressing means 50 into its high level compressing state has been delivered. If it is decided at the second step M2 that $\epsilon_{CMD}=0$, i.e., that the operational condition of the engine should be in the low level compressing state, F=0 is established at a third step M3 and then, an alarm means such as an alarm lamp is deactivated at a fourth step M4.

If it is decided at the second step M2 that $\epsilon_{CMD}=1$, the processing is advanced to a fifth step MS. At the fifth step M5, it is judged whether or not it has been detected by the detector 56 that the variable compressing means 50 is in the high level compressing state. If it is decided that the variable compressing means 50 is in the high level compressing state, i.e., it is decided so, when the operational condition of the engine should be in the low level compressing state, the processing is advanced to the third step M3.

If it is decided that the variable compressing means 50 is in the low level compressing state, i.e., it is decided so, when the operational condition of the engine should be in the high level compressing state, the processing is advanced to a sixth step M6, where F=1 is established, and then, the alarm is activated at a seventh step M7.

The operation of the first embodiment will be described below. In a condition in which the atmospheric pressure has been introduced into the control chamber 46 through the switchover valve V, the piston 31 is in its low level compressing position, so that the discharge-starting positions $P_{E'}$, $P_{E'}$ are closer to the intake port 4. This causes the internal compression ratio $\epsilon$ of the supercharger SC to be brought into 1.0. If the switchover valve V is shifted to the state permitting the supercharge pressure $P_B$ to be introduced into the control chamber 46, the piston 31 is operated to the high level compressing position, so that the discharge-starting position $P_E$ becomes the position spaced apart from the intake port 4, thereby bringing the internal compression ratio of the supercharger SC to 1.3.

In such supercharger SC, because the piston 31 is movable in the moving direction 32 substantially perpendicular to the axes of the main and gate rotors 7 and 8, an increase in size of the housing 6 is avoided, and even if a distribution of temperature is produced along the axis of the housing 6, a disadvantage due to a difference between thermal expansion amounts is not produced. In addition, because the construction is not such that a gas is circulated, a reduction in efficiency of operation is also avoided.

Additionally, the provision of the communication hole 49 in the piston 31 to permit the communication of the discharge port 5 with the back pressure chamber 39 ensures that an equal pressure can be applied to the opposite surfaces of the piston 31 to stably maintain the position of the piston 31 and to reduce the operating force required for operating the piston 31 for switchover.

Moreover, in the drive mechanism 38, the piston 31 is moved to the high level compressing position by the pressure discharged from the supercharger SC and therefore, the position of the piston 31 is stabilized due to avoiding a dynamic pressure differential within the supercharger SC in the high level compressing state in which the internal compression ratio $\epsilon$ is 1.3, and thus, it is possible to prevent a reduction in efficiency due to the unstabilization of the position of the piston 31. In contrast, if the construction is such that the piston 31 is moved to the high level compressing position by the spring force of the spring 42, the position of the piston 31 becomes unstable due to the dynamic pressure in the high level compressing state.

The shifting of the switchover valve V, i.e., the changeover of the internal compression ratio $\epsilon$ of the supercharger SC, is controlled in accordance with the supercharge pressure $P_B$ and the number $N_E$ of revolutions of the engine crankshaft and therefore, the generation of a pulsation due to a difference between the pressure within the supercharger SC and the supercharge pressure $P_B$ according to the number $N_E$ of revolutions of the engine crankshaft is avoided, thereby preventing the generation of noise due to the generation of the pulsation.

In switching-over the low level compressing state to the high level compressing state, the bypass valve $V_{BP}$ is closed and therefore, it is difficult for any noise produced at the discharge side of the supercharger to leak to the outside through the air cleaner A. For this reason, even if the switchover is somewhat delayed, the noise cannot leak out. Unless the condition in which the low level compressing state should be switched over to the high level compressing state is sustained for the predetermined time, e.g., 3 seconds, the switching-over to the high level compressing state is not performed and therefore, the frequency of operation of the piston 31 can be minimized, leading to an improved durability thereof. Moreover, if the driver has a strong desire to accelerate, i.e., if the $\Delta\theta_{TH}$ is larger than the predetermined value, $\theta_{TH}>\theta_{DEL}$ and $N_E>N_{DEL}$, the low level compressing state is immediately switched over to the high level compressing state and therefore, no problem arises in responsiveness.

In switching-over the high level compressing state to the low level compressing state, the bypass valve $V_{BP}$ is opened and therefore, it is possible to prevent noise from being leaked to the outside by performing the switching-over operation without delay.

Further, since the maximum supercharge pressure, i.e., the preset supercharge pressure in the low level compressing state is set, so that it gradually increases, as the number $N_E$ of revolutions of engine increases, it is possible to properly accommodate the fact that the internal compression ratio is increased, as the number $N_E$ of revolutions of the engine crankshaft increases.

Yet further, if the drive mechanism 38 is out of order for some reason as the low level compressing state is maintained, when the engine is brought into an operation condition in which a high supercharge pressure $P_B$ is introduced, the bypass valve $V_{BP}$ is operated into its opened position by the control means C, thereby permitting the supercharge pressure $P_B$ to be reduced, so that it is equal to or lower than the preset supercharge pressure $P_{BL}$. Therefore, the temperature of the intake gas in the engine is not increased due to any trouble in drive mechanism 38 and knocking in the engine is also prevented.

Although the target opening degree $\theta_{BP}^{0'}$ of the bypass valve $V_{BP}$ is determined in accordance with the number $N_E$ of revolutions of the engine crankshaft and the throttle opening degree $\theta_{TH}$ at the ninth step S9 shown in FIG. 5, so that the open control is carried out in the above-described embodiment, it should be understood that the target supercharge pressure may be determined in the low level compressing state, so that the feed-back control may be carried out.

Figure 15:
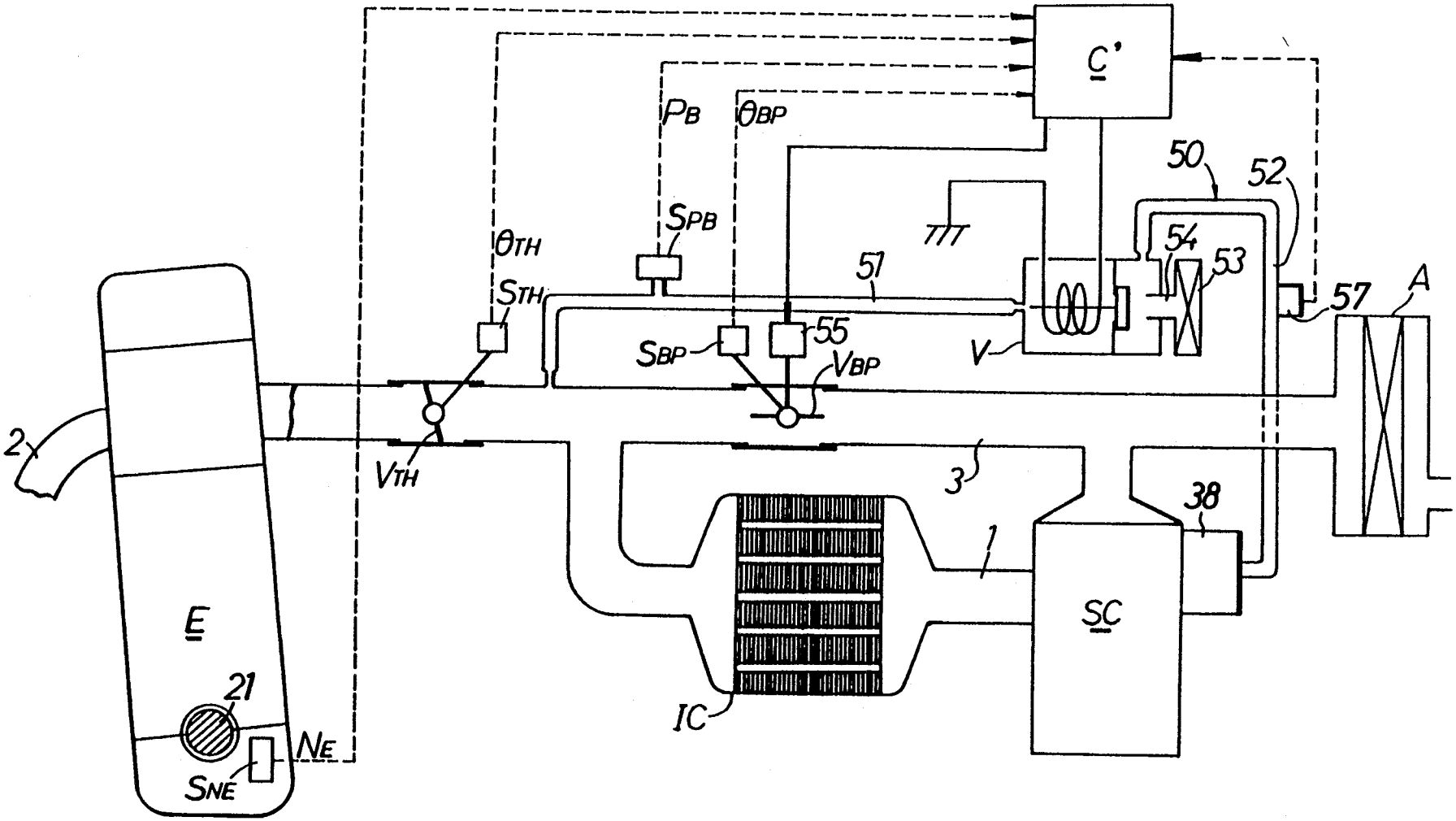
Figure 16:
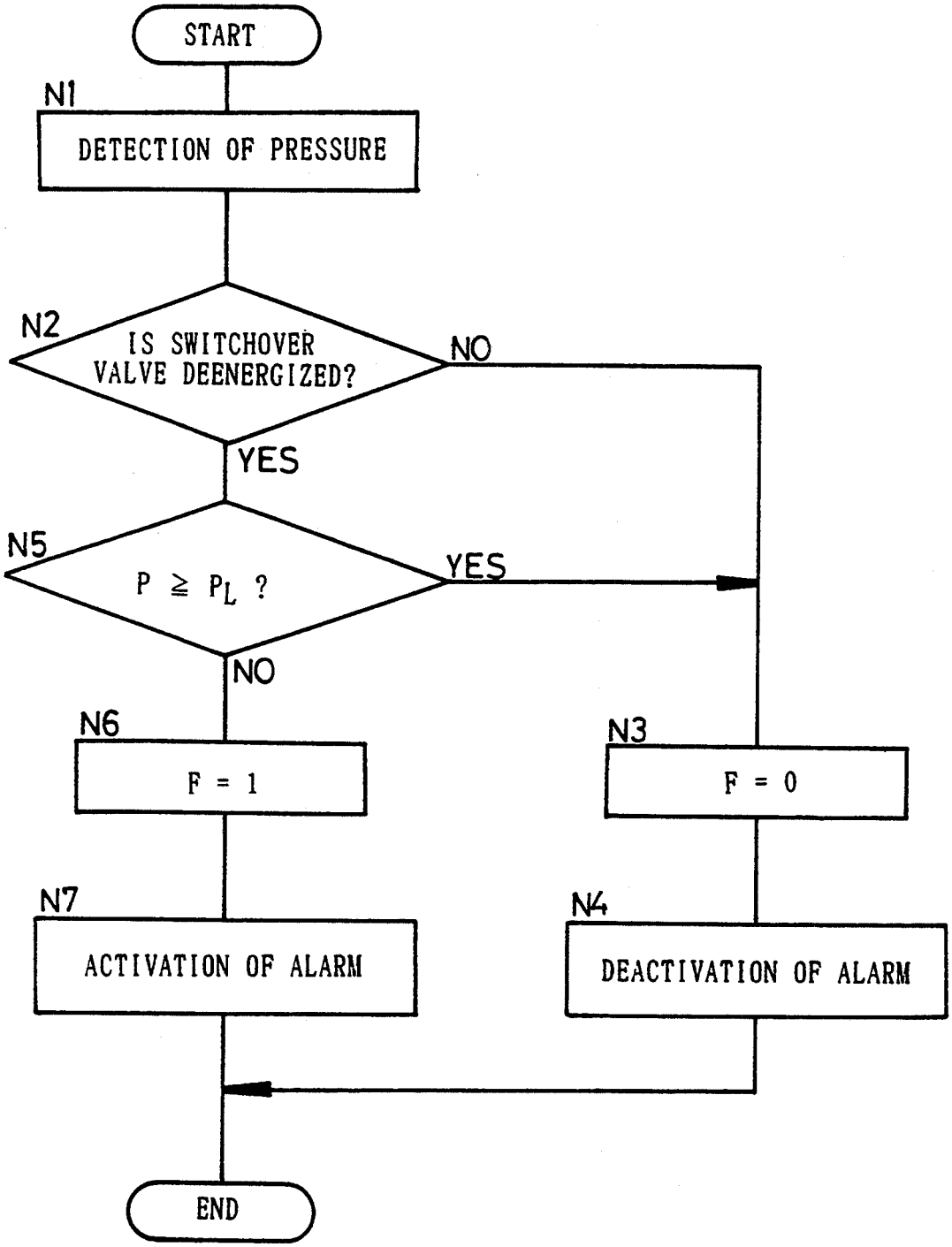

FIGS. 15 and 16 illustrate a second embodiment of the present invention, wherein like reference characters are used to designate the parts or components corresponding to those in the above-described first embodiment.

Referring first to FIG. 15, a pressure sensor 57 as a detector is mounted in the middle of the conduit 52 connecting the drive mechanism 38 and the switchover valve V of the variable compressing means 50. The pressure in the conduit 52 is detected by the pressure .sensor 57, and a detection signal from the pressure sensor 57 is received in a control means C'.

A procedure for detecting an abnormality of the variable compressing means 50 is established in the control means C' as shown in FIG. 16 At a first step N1 in FIG. 16, the pressure in the conduit 52 is detected by the pressure sensor 57. At a second step N2, it is judged whether or not the switchover valve V has been deenergized to permit the supercharge pressure $P_B$ to be introduced into the conduit 52, thereby bringing the drive mechanism 38 into the high level compressing state. When the drive mechanism 38 should be brought into the low level compressing state by energizing the switchover valve V to permit the atmospheric pressure to be introduced into the conduit 52, the processing is advanced to a third step N3. At the third step N3, the flag F is set at "0" (F=0), and at a fourth step N4, the alarm is deactivated.

If it is decided at the second step N2 that the switchover valve V has been deenergized, the processing is advanced to a fifth step N5. At the fifth step N5, it is judged whether or not the pressure P detected by the pressure sensor 57 is equal to or larger than a preset pressure $P_L$, i.e., whether or not the supercharge pressure $P_B$ has been introduced into the conduit 52. If it is decided that the supercharge pressure $P_B$ has been introduced into the conduit 52, the processing is advanced to the third step N3. On the other hand, if it is decided that the supercharge pressure $P_B$ is not introduced into the conduit 52, the flag F is set at "1" at a sixth step N6 and then, at a seventh step N7, the alarm is activated.

With the second embodiment, it is decided that there is an abnormality produced, if the variable compressing means 50 remains in the low level compressing state, when the variable compressing means 50 should be brought into the high level compressing state for some reason, e.g., due to any trouble with the switchover valve V. On the basis of this decision, the supercharge pressure $P_B$ can be reduced, thereby providing an effect similar to that in the first embodiment.

Figure 17:
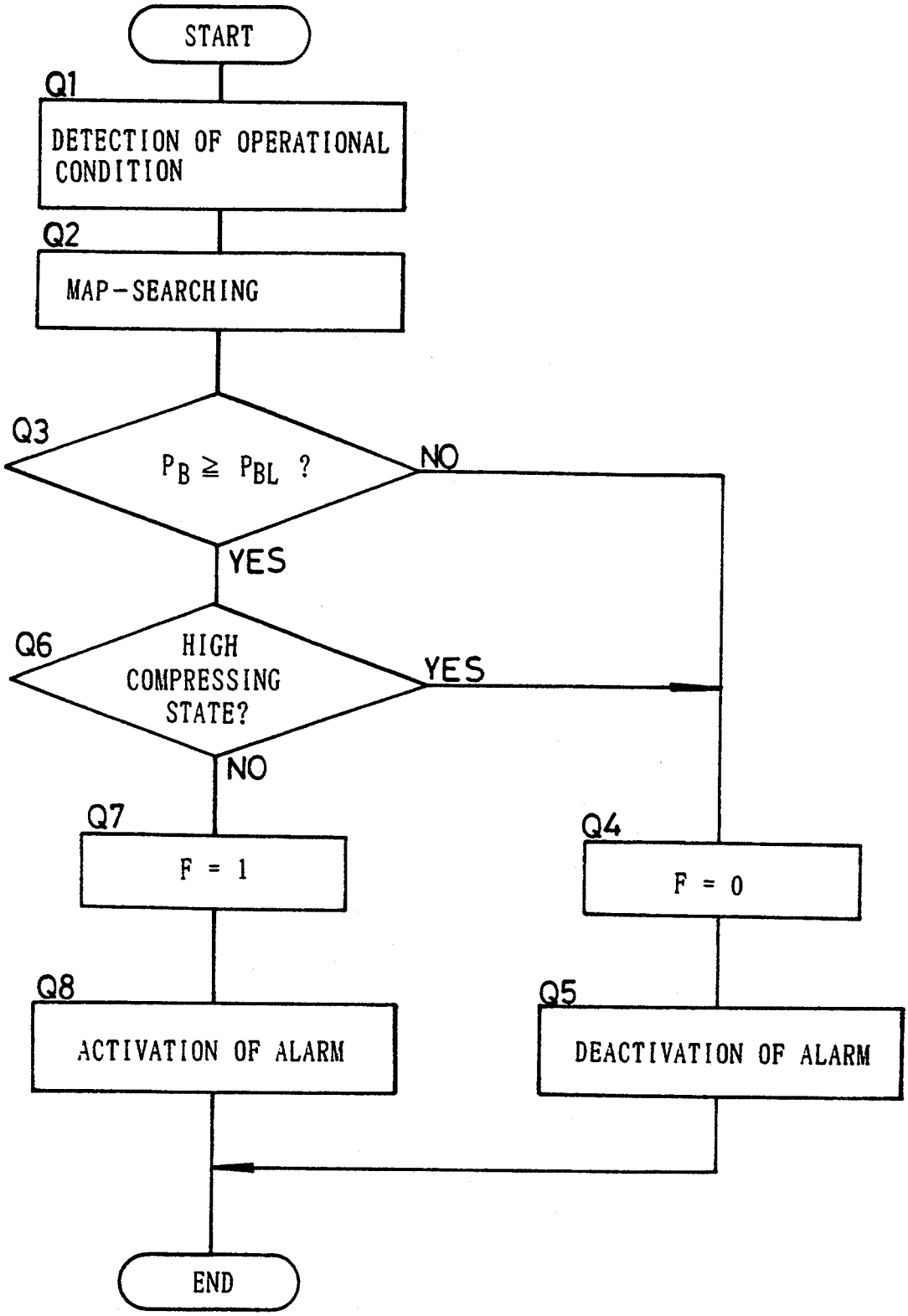
Figure 18:
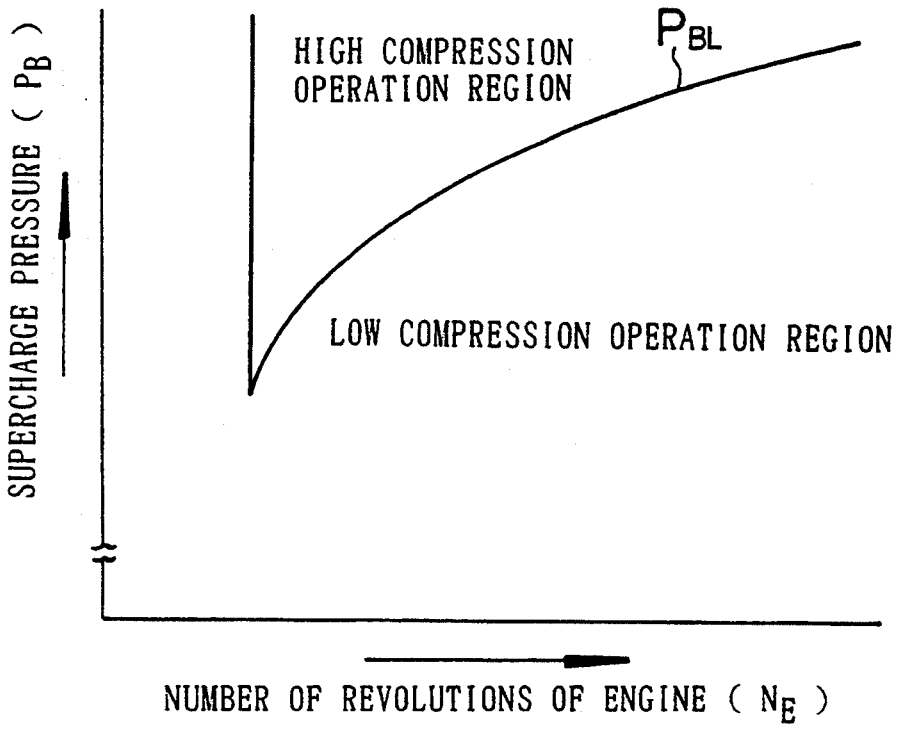

FIGS. 17 and 18 illustrate a third embodiment of the present invention.

Referring to FIG. 17 illustrating a procedure for detecting an abnormality of the variable compressing means 50 (see FIG. 1), the operational condition of the variable compressing means 50 is detected at a first step Q1 by the detector 56 (see FIG. 1). At a next second step Q2, the searching is carried out according to a map shown in FIG. 18. A region in which the operational condition of the engine should be in a low level compressing state based on the number $N_E$ of revolutions of the engine crankshaft and the supercharge pressure $P_B$, and a region in which such operational condition should be in a high level compressing state are previously established in this map. A preset supercharge pressure $P_{BL}$ indicating the maximum supercharge pressure in the region in which the operational condition of the engine should be in the low level compressing state is set so that such maximum pressure increases, as the number $N_E$ of revolutions of the engine crankshaft increases.

From the result of the searching at the second step Q2, it is judged at a third step Q3 whether or not the supercharge pressure $P_B$ is equal to or larger than the preset supercharge pressure $P_{B1}$ ($P_B \geqq P_{B1}$). If it is decided that $P_B < P_{B1}$, i.e., that the operational condition of the engine should be in the low level compressing state, F=0 is established at a fourth step Q4 and then, at a fifth step Q5, an alarm means such as an alarm lamp is deactivated.

If it is decided at the third step Q3 that $P_B \geqq P_{B1}$, it is judged at a next sixth step Q6 whether or not it has been detected by the detector 56 that the variable compressing means 50 is in the high level compressing state. If it is decided that the variable compressing means 50 is in the high level compressing state, the processing is advanced to the fourth step Q4. On the other hand, if it is decided that the variable compressing means 50 is in the low level compressing state, i.e., it is detected by the detector 56 that the variable compressing means 50 is in the low level compressing state, when the operational condition of the engine should be in the high level compressed state, F=1 is established at a seventh step Q7 and then, the alarm means is activated at an eighth step Q8.

It should be noted that the judging map shown in FIG. 18 substantially corresponds to that shown in FIG. 9 illustrating the supercharge introducing region and the atmospheric pressure introducing region, but is set with a margin left in a low-compression operating region (atmospheric introducing region) from the boundary region shown in FIG. 9, so that it is not decided that there is an abnormality, even if the operational condition of the engine slightly enters the supercharge introducing region shown in FIG. 9 in the low level compressing state.

Although specific embodiments of the present invention have been described above, it will be understood that the present invention is not intended to be limited to these embodiments, and various minor modifications can be made without departing from the spirit and scope of the invention defined in the claims.

We claim:

1. A system for controlling the supercharge pressure in an internal combustion engine having a mechanical supercharger which is connected to a crankshaft of the engine and includes a variable compressing means capable of varying an internal compression ratio, said system comprising:

a supercharge pressure varying means for varying a supercharge pressure which is fed through a passage to the engine a detector for detecting the operational condition of the variable compressing means, and a control means for operating the supercharge pressure varying means towards a supercharge pressure reducing position in response to the operational condition of the variable compressing means being detected, by the detector, as establishing a low level compressing state in an operational condition of the engine in which the mechanical supercharger should be brought into a high level compressing state.

2. A system for controlling the supercharge pressure in an internal combustion engine according to claim 1, wherein said control means is arranged to control said supercharge pressure varying means in such a manner that the acceptable maximum supercharge pressure, in the event when id mechanical supercharger is in the low level compressing state, increases as the number of revolutions of the engine crankshaft increase.

3. A system for controlling the supercharge pressure in an internal combustion engine according to claim 1, wherein said passage is a bypass passage separate from the supercharger and said supercharge pressure varying means is a valve in said bypass passage.

4. A system for controlling the supercharge pressure in an internal combustion engine according to claim 3, wherein means are provided for detecting abnormal engine operating conditions among at least intake air temperature, engine cooling water temperature and engine load, and means for opening said valve in the bypass passage upon detection of said abnormal engine operating condition.

5. A system for controlling the supercharge pressure in an internal combustion engine according to claim 1, wherein said detector includes means for detecting the physical position of said variable compressing means.

6. A system for controlling the supercharge pressure in an internal combustion engine according to claim 1, wherein said variable compressing means is operated by selective applications of air pressure supply from the supercharger or atmosphere.

7. A system for controlling the supercharge pressure in an internal combustion engine according to claim 6, wherein a selectively operable valve switches the air pressure supply from the supercharger or atmosphere.

8. A system for controlling the supercharge pressure in an internal combustion engine according to claim 6, wherein said detector includes means responsive to said air pressure supply.

9. A system for controlling a supercharge pressure in an internal combustion engine having a mechanical supercharger which is connected to a crankshaft of an engine and includes means for varying internal combustion ratio of the supercharger, said system comprising means for detecting an operational condition of the supercharger, and control means for controlling the supply of the supercharge pressure to the engine, said control means providing a supercharge pressure reducing condition in response to detection by the detector of the supercharger being in a low level compressing state in an operational condition of the engine in which the supercharger should be brought into a high level compressing state.

10. A system for controlling the supercharge pressure in an internal combustion engine according to claim 9, wherein said control means is arranged to control said supercharger in such a manner that the acceptable maximum supercharge pressure, in the event when said supercharger is in the low level compressing state, is increased as the number of revolutions of the engine crankshaft is increased.

11. A system for controlling the supercharge pressure in an internal combustion engine according to claim 9, including a bypass passage for supplying air to the engine separate from the supercharger and a valve in said bypass passage for controlling the supply of air through the bypass passage.

12. A system for controlling the supercharge pressure in an internal combustion engine according to claim 11, wherein means are provided for detecting abnormal engine operating conditions among at least intake air temperature, engine cooling water temperature and engine load, and means for opening said valve in the bypass passage upon detection of said abnormal engine operating condition.

* * * * *